US006183207B1

(12) United States Patent
Sturman

(10) Patent No.: US 6,183,207 B1
(45) Date of Patent: Feb. 6, 2001

(54) DIGITAL PUMP

(75) Inventor: Oded E. Sturman, Woodland Park, CO (US)

(73) Assignee: Sturman Industries, Inc., Woodland Park, CO (US)

( * ) Notice: Under 35 U.S.C. 154(b), the term of this patent shall be extended for 0 days.

(21) Appl. No.: 09/080,757

(22) Filed: May 18, 1998

(51) Int. Cl.[7] ..... F04B 1/26; F04B 23/04

(52) U.S. Cl. ..... 417/53; 417/270; 417/286; 417/287; 417/427

(58) Field of Search ..... 417/270, 286, 417/287, 295, 426, 427, 429, 53

(56) References Cited

U.S. PATENT DOCUMENTS

| | | | | |
|---|---|---|---|---|
| 4,326,839 | * | 4/1982 | Fry et al. | 417/295 |
| 5,050,233 | * | 9/1991 | Hitosugi et al. | 417/427 |
| 5,456,581 | | 10/1995 | Jokela et al. . | |
| 5,700,136 | * | 12/1997 | Sturman | 417/270 |

FOREIGN PATENT DOCUMENTS

| | | | |
|---|---|---|---|
| WO 91/04414 | A1 | 4/1991 | (WO) . |
| WO 97/43548 | A1 | 11/1997 | (WO) . |
| WO 98/03788 | A1 | 1/1998 | (WO) . |

* cited by examiner

*Primary Examiner*—Charles G. Freay
(74) *Attorney, Agent, or Firm*—Blakely, Sokoloff, Taylor & Zafman LLP

(57) ABSTRACT

A pump which can operate in a number of different modes, wherein each mode corresponds to a different output of the pump. The pump may have a plurality of pump chambers located within a pump housing. The pump chambers may be arranged in fluid communication with an inlet port and an outlet port. Each pump chamber may have a pumping device which draws in fluid from the inlet port during an intake stroke and pushes fluid through the outlet port during a discharge stroke. The pump may also have a plurality of electronically controlled valve assemblies which control the output of the pump. Each valve assembly can be selectively switched to a by-pass state for by-passing the fluid flowing from the pump chamber back to the inlet port during the discharge stroke of a pumping device. The pump may operate in a number of different modes which each have a distinct output. Each mode may be defined by which valves are chosen to be switched to their by-pass state.

21 Claims, 2 Drawing Sheets

DIGITAL PUMP

BACKGROUND OF THE INVENTION

1. Field of the Invention

The present invention relates to a pump.

2. Background Information

Pumps are used to create fluid flow and increase a fluid pressure within an hydraulic system. For example, some internal combustion engines contain a pump that increases the pressure of hydraulic fluid which is used to hydraulically actuate intensified fuel injectors of the engine. Such engine pumps may contain one or more pistons that are reciprocated within a pump chamber by a wobble plate. Each revolution of the wobble plate causes the piston to draw in fluid through an inlet port and then pressurize and push the fluid through an outlet port of the pump.

The wobble plate is mechanically coupled to the rotational output of the engine. The speed of the pump is controlled by the speed of the engine. Consequently, the output of the pump increases with a corresponding increase in the engine speed. It may be desirable to increase or decrease the output of the pump without varying the speed of the engine. It would therefore be desirable to provide a pump which can vary the pump output to a number of different levels for a given input speed of the pump.

SUMMARY OF THE INVENTION

One embodiment of the present invention is a pump which can selectively operate in a number of different modes, wherein each mode corresponds to a different output of the pump. The pump may have a plurality of pump chambers located within a pump housing. The pump chambers may be coupled to an inlet port and an outlet port. Each pump chamber may have a pumping device which draws in fluid from the inlet port during an intake stroke and pushes fluid through the outlet port during a power stroke. The pump may also have a plurality of valve assemblies which control the output of the pump. The valve assemblies may be operated in a number of different modes. Each mode creates a different pump output.

DETAILED DESCRIPTION OF THE INVENTION

One embodiment of the present invention is a pump which can operate in a number of different modes, wherein each mode corresponds to a different output of the pump. The pump may have a plurality of pump chambers located within a pump housing. The pump chambers may be coupled to an inlet port and an outlet port. Each pump chamber may have a pumping device which draws in fluid from the inlet port during an intake stroke and pushes fluid through the outlet port during a discharge stroke. The pump may also have a plurality of electronically controlled valve assemblies which control the output of the pump. Each valve assembly can be switched to a by-pass state to by-pass the fluid flowing from the pump chamber back to the inlet port during the discharge stroke of a pumping device. The pump may operate in a number of different modes which each have a distinct pump output. Each mode may be defined by which valves are selectively switched to the by-pass state. The number of valves switched or not switched to their by-pass state define the output of the pump. The pump can vary the output without having to change the input speed of the pump.

Figure 1:
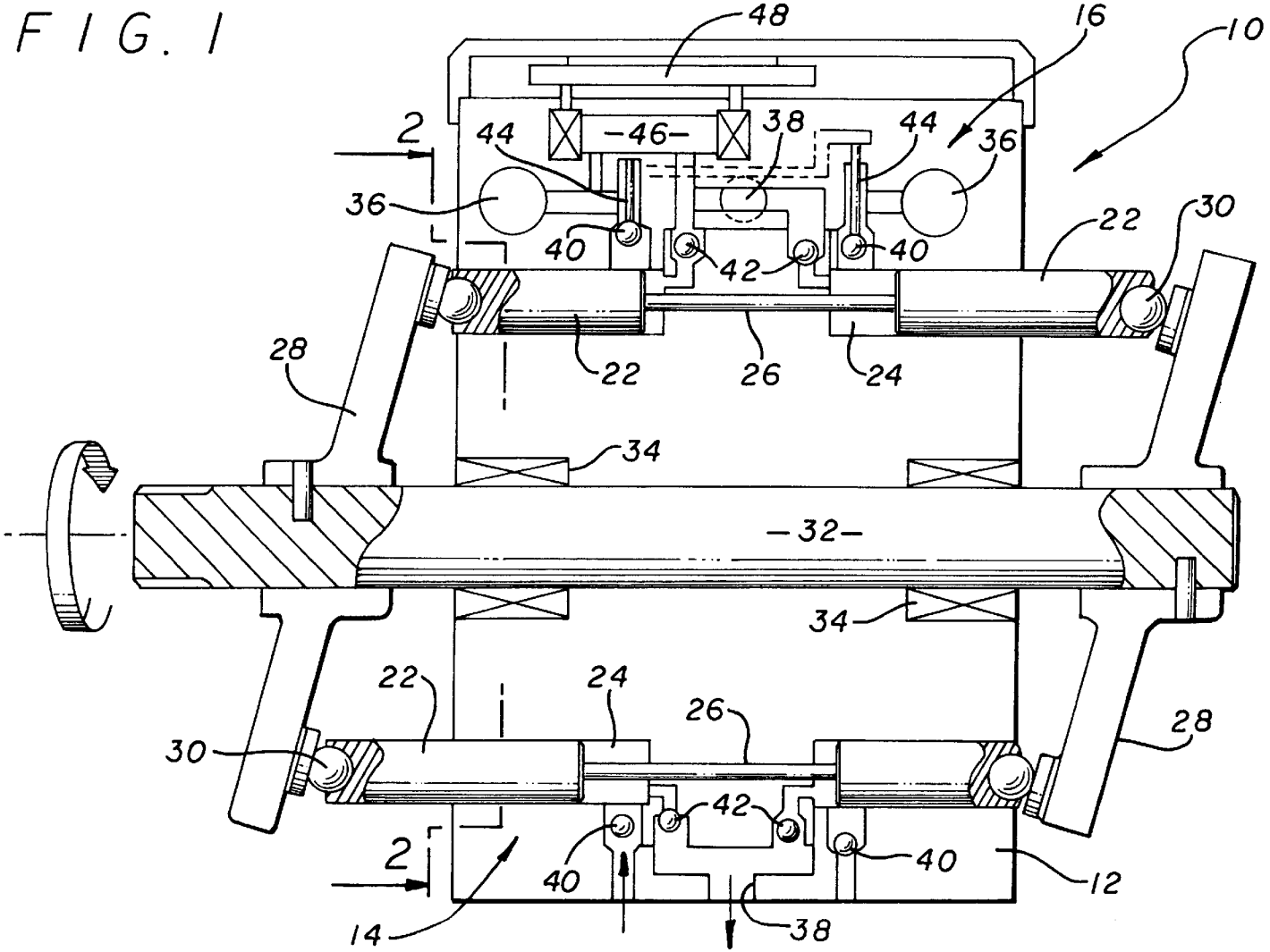
FIG. 1 is a cross-sectional view of an embodiment of a pump of the present invention.
Figure 2:
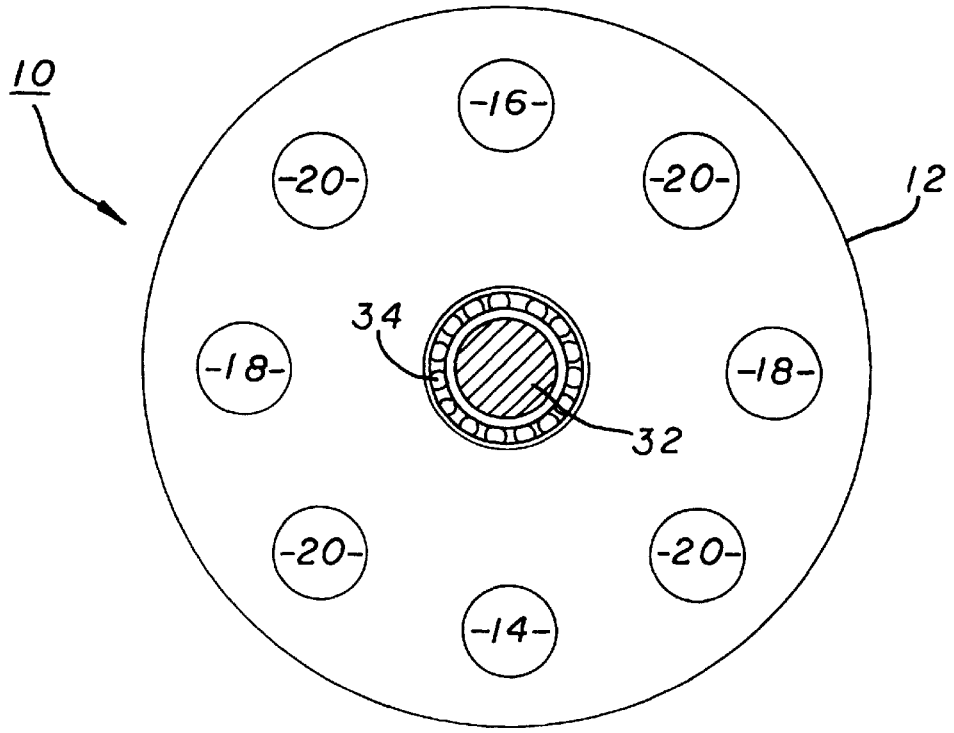
FIG. 2 is a bottom sectional view of the pump taken along line 2—2 of FIG. 1.

Referring to the drawings more particularly by reference numbers, FIGS. 1 and 2 show an embodiment of a fluid pump 10 of the present invention. The pump 10 may include a pump housing 12 which has a first pump subassembly 14, a second pump subassembly 16, a pair of third pump subassemblies 18 and four fourth pump subassemblies 20. Each pump subassembly may include a pair of pistons 22 that are located within a pump chamber 24. The pair of pistons 22 may be connected to each other by a pin 26.

The pistons 22 may be coupled to a pair of wobble plates 28 by a number of ball joints 30. The wobble plates 28 are rotated by a shaft 32 that extends through the pump housing 12. The shaft 32 may be supported by bearings 34. The shaft 32 is rotated by an external power source. By way of example, the shaft 32 may be coupled to an internal combustion engine.

The pump chambers 24 are arranged in fluid communication with the inlet ports 36 and outlet ports 38 of the pump housing 12. Each pump chamber 24 has an associated one-way inlet check valve 40 which normally allows fluid to flow into the chamber 24 from the inlet port 36, but does not allow a reverse flow from the chamber 24 back through the inlet port 36. Each pump chamber 24 may also have an associated one-way outlet check valve 42 which allows one-way flow from the chamber 24 to the outlet port 38.

Although multiple inlet ports 36 and outlet ports 38 are shown and described, the pump may have a single inlet port and a single outlet port that are arranged in fluid communication with the pump chambers by passages in the pump housing 12.

In operation, the wobble plates 28 move the pistons 22 between an intake stroke and a discharge stroke. During the intake stroke, the pump chamber 24 is expanded to create a negative pressure within the chamber 24. The negative pressure allows the fluid pressure at the inlet port 36 to push open the inlet check valve 40 so that fluid flows into the pump chamber 24.

During the discharge stroke, the piston 22 pressurizes the fluid within the pump chamber 24 and pushes that fluid through the outlet check valve 42 and through the outlet port 38.

The inlet check valves 40 of the second 16, third 18 and fourth 20 pump subassemblies may each be coupled to a hydraulically-driven piston 44. The pistons 44 can move the check valves 40 into an open position to allow fluid to flow from the pump chambers 24 back into the inlet ports 36 during a discharge stroke of the respective pistons 22.

The pistons 44 are controlled by a control valve 46. The control valve 46 may be a double solenoid three-way valve that is also arranged in fluid communication with either the inlet port 36 or the outlet 38 port. In one state, the control valve 46 provides fluid communication between the piston 44 and the high pressure outlet port 38 so that the hydraulic pressure within the outlet 38 moves the piston 44 and opens the inlet check valve 40. In a second state, the control valve 46 provides fluid communication between the piston 44 and the low pressure inlet port 36 so that the inlet check valve 40 can move back to the closed position during the discharge stroke of the piston 22. There may be a single second control valve for the second pump subassembly 16, a single third control valve for the third pump subassemblies 18 and a single control valve for the fourth pump subassemblies 20.

The control valves 46 may be electrically coupled to a programmable controller 48 which provides electrical current to switch the valves 46. The control valves 46 may be constructed from a steel material which retains enough residual magnetism to maintain a state of the valve 46 even when electrical current is not supplied by the controller 48. The control valves 46 may be similar to the valves disclosed in U.S. Pat. No. 5,640,987 issued to Sturman, which is hereby incorporated by reference. The controller 48 can discretely vary the state of any control valve 46 so that any combination of valves 46 are in a by-pass state. In this manner, the controller 48 can define a number of different modes for the pump 10.

Figure 3:
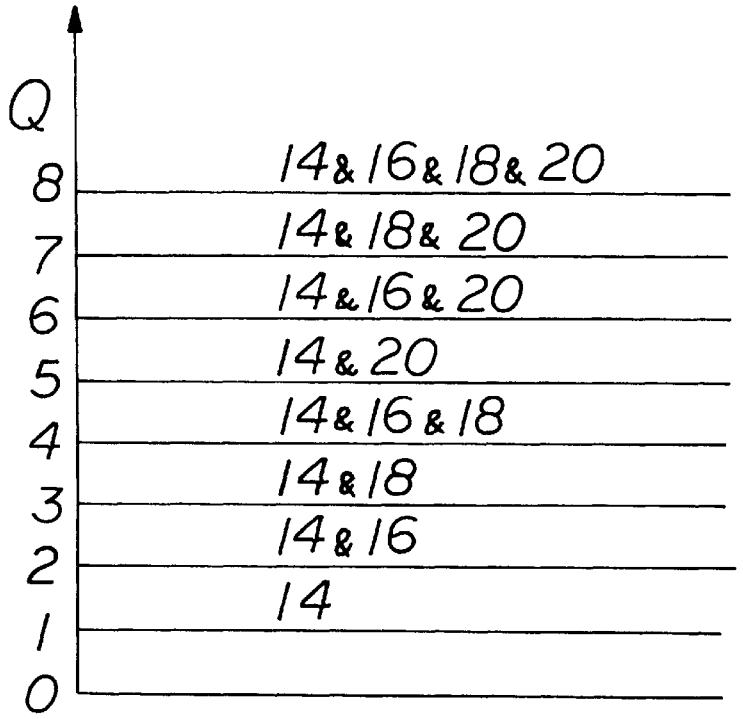
FIG. 3 is a graph showing the different output modes of the pump.

FIG. 3 shows the output flowrate of the pump 10 for different pump modes 1–8. The graph shows which pump subassemblies, first 14, second 16, third 18 and/or fourth 20 are effectively pumping for each mode 1–8. For example, in the first mode, the valves of the second 16, third 18 and fourth 20 pump subassemblies are set to their by-pass state so that only the first pump assembly 14 is pumping fluid out of the pump 10. In the second mode, the third 18 and fourth 20 subassemblies are set to their by-pass state so that only the first 14 and second 16 subassemblies are effectively pumping fluid. The first assembly 14 and the third subassemblies 18 effectively pump when the system is in the third mode and so forth and so on. The various modes may each provide a different output flowrate for the pump 10.

By varying the by-pass states of the valves 46, the controller 48 can change the fluid output of the pump 10 without changing the speed of the shaft 32. When incorporated into a system such as an internal combustion engine, the fluid output of the pump 10 can be varied independently from the speed of the engine. This advantageously provides more flexibility in the design, operation and performance of the engine.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A pump comprising:

a housing having an inlet port, an outlet port and a pair of pumping chambers;

a pair of connected and coutra-acting pumping pistons that is located within the pair of pumping chambers such that an intake stroke of one pumping piston corresponds to a discharge stroke of the connected pumping piston, the pair of pistons arranged to pump a fluid from the inlet port to the outlet port;

an inlet check valve coupled to each of the pair of pumping chambers that controls a flow of the fluid from the inlet port to the pumping chamber, wherein the inlet check valve provides fluid communication between the pumping chamber and the inlet port when in an open position; and, a control piston coupled to the inlet check valve in each of the pair of pump chambers, each of the two control pistons coupled to move and maintain the inlet check valve in an open position when supplied with a pressurized fluid, and a control valve arranged to selectively supply pressurized fluid to the two control pistons.

2. The pump as recited in claim 1, wherein the control valve contains a first solenoid and a second solenoid which move a spool between a first position and a second position, wherein the control valve allows the fluid to flow to the two control pistons and move the inlet check valves into the open position when the spool is in the second position.

3. The pump as recited in claim 2, wherein the spool is maintained in one of the first and second positions by residual magnetism.

4. The pump as recited in claim 2, wherein the control valve is a three-way valve having a return port and a supply port that provides fluid communication between the two control pistons and the return port when the spool is in the first position and between the two control pistons and the supply port when the spool is in the second position.

5. The pump as recited in claim 4, wherein the return port of the control valve is coupled to the inlet port of the housing and the supply port of the control valve is coupled to the outlet port of the housing.

6. The pump as recited in claim 1, further comprising a wobble plate that reciprocates the pair of pistons through the intake and discharge strokes and pumps the fluid out of the pumping chamber.

7. The pump as recited in claim 1, further comprising a controller that actuates the control valve.

8. A pump, comprising:

a pump housing;

an inlet port defined on the pump housing and adapted to receive a fluid;

an outlet port defined on the pump housing and adapted to discharge the fluid; and a plurality of pump subassemblies positioned within the pump housing and arranged in fluid communication with the inlet and outlet ports, each of the pump subassemblies including a pair of pump chambers, a pair of connected and contra-acting pumping pistons positioned within the pump chambers and arranged such that an intake stroke of one pumping piston corresponds to a discharge stroke of the connected pumping piston, an inlet check valve coupled to each of the pair of pump chambers, each inlet check valve arranged to control fluid communication between the inlet port and the pump chamber, a control piston coupled to the inlet check valve in each of the pair of pump chambers, each control piston coupled to move the inlet check valve into an open position in response to a pressurized fluid, and a single control valve arranged to control fluid communication between the outlet port and the two control pistons to selectively move the inlet check valve into the open position.

9. The pump as recited in claim 8, wherein the control valve contains a first solenoid and a second solenoid which move a spool between a first position and a second position, wherein the control valve allows the fluid to flow to the two control pistons and move the inlet check valves into the open position when the spool is in the second position.

10. The pump as recited in claim 9, wherein the spool is maintained in one of the first and second positions by residual magnetism.

11. The pump as recited in claim 9, wherein the control valve is a three-way valve having a return port and a supply port that provides fluid communication between the two control pistons and the return port when the spool is in the first position and between the two control pistons and the supply port when the spool is in the second position.

12. The pump as recited in claim 11, wherein the return port of the control valve is coupled to the inlet port of the housing and the supply port of the control valve is coupled to the outlet port of the housing.

13. The pump as recited in claim 8, further comprising a wobble plate that reciprocates the pair of pistons through the intake and discharge strokes and pumps the fluid out of the pumping chamber.

14. The pump as recited in claim 8, further comprising a controller that selectively actuates a number of the control valves in the plurality of pump subassemblies to control a flowrate of fluid through said outlet port.

15. A method of controlling a pump comprising:

reciprocating a pair of connected and coutra-acting pumping pistons within a pair of pumping chambers such that an intake stroke of one pumping piston corresponds to a discharge stroke of the connected pumping piston, the pair of pistons pumping a fluid from an inlet port to an outlet port;

providing an inlet check valve for each of the pair of pumping chambers that controls a flow of the fluid from the inlet port to the pumping chamber, wherein the inlet check valve provides fluid communication between the pumping chamber and the inlet port when in an open position; and, selectively supplying pressurized fluid to a control piston coupled to the inlet check valve in each of the pair of pump chambers, each of the two control pistons coupled to move and maintain the inlet check valve in an open position when supplied with a pressurized fluid.

16. The method as recited in claim 15, wherein selectively supplying pressurized fluid includes moving a spool in a control valve between a first position and a second position, wherein the control valve allows the fluid to flow to the two control pistons and move the inlet check valves into the open position when the spool is in the second position.

17. The method as recited in claim 16, wherein selectively supplying pressurized fluid further includes maintaining the spool in one of the first and second positions by residual magnetism.

18. The method as recited in claim 16, wherein the control valve is a three-way valve having a return port and a supply port that provides fluid communication between the two control pistons and the return port when the spool is in the first position and between the two control pistons and the supply port when the spool is in the second position.

19. The method as recited in claim 16, wherein the return port of the control valve is coupled to the inlet port of the housing and the supply port of the control valve is coupled to the outlet port of the housing.

20. The method as recited in claim 15, wherein reciprocating a pair of pistons further includes rotating a wobble plate that reciprocates the pair of pistons.

21. The method as recited in claim 15, further comprising actuating the control valve with a controller.

* * * * *